US007523875B2

(12) United States Patent
Cooke et al.

(10) Patent No.: US 7,523,875 B2
(45) **Date of Patent: *Apr. 28, 2009**

(54) INJECTION NOZZLE

(75) Inventors: Michael Peter Cooke, Gillingham (GB); Godfrey Greeves, Middlesex (GB)

(73) Assignee: Delphi Technologies, Inc., Troy, MI (US)

( * ) Notice: Subject to any disclaimer, the term of this patent is extended or adjusted under 35 U.S.C. 154(b) by 299 days.

This patent is subject to a terminal disclaimer.

(21) Appl. No.: 11/235,800

(22) Filed: Sep. 27, 2005

(65) Prior Publication Data

US 2006/0071100 A1 Apr. 6, 2006

(30) Foreign Application Priority Data

Oct. 1, 2004 (EP) ..... 04256105

(51) Int. Cl.
*F02M 61/00* (2006.01)

(52) U.S. Cl. ..... 239/533.12; 239/44; 239/533.2; 239/533.3; 239/533.5

(58) Field of Classification Search ..... 239/88, 239/89, 444, 533.2–533.5, 533.9, 533.1, 239/533.12, 533.11, 585.1–585.5
See application file for complete search history.

(56) References Cited

U.S. PATENT DOCUMENTS

| | | | | |
|---|---|---|---|---|
| 4,083,498 | A * | 4/1978 | Cavanagh et al. | 239/533.3 |
| 5,899,389 | A * | 5/1999 | Pataki et al. | 239/533.2 |
| 6,431,469 | B2 * | 8/2002 | Lambert et al. | 239/533.3 |
| 6,896,208 | B2 * | 5/2005 | Kuegler | 239/533.4 |
| 6,902,124 | B2 * | 6/2005 | Arndt et al. | 239/533.2 |
| 7,117,842 | B2 * | 10/2006 | Boehland et al. | 123/299 |
| 7,143,964 | B2 * | 12/2006 | Kuegler | 239/533.12 |
| 2001/0052554 | A1 | 12/2001 | Lambert et al. | |
| 2006/0032948 | A1 * | 2/2006 | Smout et al. | 239/533.2 |

FOREIGN PATENT DOCUMENTS

| | | |
|---|---|---|
| FR | 2328855 | 5/1977 |
| GB | 1560614 | 2/1980 |
| WO | WO 2004044415 A1 * | 5/2004 |
| WO | WO 2004/074677 | 9/2004 |

* cited by examiner

*Primary Examiner*—Len Tran
*Assistant Examiner*—Jason J Boeckmann
(74) *Attorney, Agent, or Firm*—David P. Wood

(57) ABSTRACT

An injection nozzle (4) for an internal combustion engine, the injection nozzle (4) including a nozzle body (6) provided with a bore (8) defining a valve seating surface, and having a first nozzle outlet and a second nozzle outlet, a first delivery chamber upstream of said nozzle outlets, an outer valve member, moveable within the bore (8) and itself provided with an axial bore (8), wherein the outer valve member is engageable with an outer valve seat defined by the valve seating surface so as to control fuel flow from a first delivery chamber to at least the first nozzle outlet when the outer valve member lifts from its seat. The injection nozzle (4) also includes an inner valve member, moveable within the axial bore (8) and including first and second seating lines spaced apart axially from each other, both seating lines being engageable with an inner valve seat defined by the valve seating surface so as to control fuel flow from a second delivery chamber to the second nozzle outlet when the inner valve member lifts from inner valve seat. The inner valve member defines, at least in part, a flow path including an axial passage provided in the inner valve needle such that fuel may flow from the first delivery chamber to the second delivery chamber.

14 Claims, 8 Drawing Sheets

INJECTION NOZZLE

TECHNICAL FIELD

The present invention relates to an injection nozzle for use in a fuel injection system for an internal combustion engine. More particularly, although not exclusively, the present invention relates to an injection nozzle for use in a compression ignition internal combustion engine in which first and second valve needles are operable to control the injection of fuel into a combustion space through a plurality of nozzle outlets.

BACKGROUND ART

Due to increasingly stringent environmental regulations, a great deal of pressure is levied upon automotive manufacturers to reduce the level of vehicle exhaust emissions, for example, hydrocarbons, nitrogen oxides (NOx) and carbon monoxide. As is well known, an effective method of reducing exhaust emissions is to supply fuel to the combustion space at high injection pressures (around 2000 bar for example) and to adopt nozzle outlets of a small diameter in order to optimise the atomisation of fuel and so improve efficiency and reduce the levels of hydrocarbons in the exhaust gases. Although the above approach is effective at improving fuel efficiency and reducing harmful engine exhaust emissions, an associated drawback is that reducing nozzle outlet diameter conflicts against the requirement for high fuel injection flow rates at high engine loads and so can compromise vehicle performance.

So-called "variable orifice nozzles" (VON-nozzles) enable variation in the number of orifices (therefore the total orifice area) used to inject fuel into the combustion space at different engine loads. Typically, such an injection nozzle has at least two sets of nozzle outlets with first and second valve needles being operable to control whether fuel injection occurs through only one of the sets of outlets or through both sets simultaneously. In a known injection nozzle of this type, as described in the Applicant's co-pending European patent application no. EP 04250928.1, the fuel flow to a first (upper) set of nozzle outlets is controlled by an outer valve needle and the fuel flow to a second (lower) set of nozzle outlets is controlled by an inner valve needle. The inner valve needle is lifted by the outer valve needle only after the flow of fuel through the first set of nozzle outlets has reached a sufficient rate. An injection nozzle of this type enables selection of a small total nozzle outlet area in order to optimise engine emissions at relatively low engine loads. On the other hand, a large total nozzle outlet area may be selected so as to increase the total fuel flow at relatively high engine loads.

DISCLOSURE OF INVENTION

It is against this background that the present invention has been devised. The invention provides an injection nozzle for an internal combustion engine, the injection nozzle including a nozzle body provided with a bore defining a valve seating surface, and having a first nozzle outlet and a second nozzle outlet. The injection nozzle further includes a first delivery chamber upstream of said nozzle outlets, an outer valve member, moveable within the bore and itself provided with an axial bore. The outer valve member is engageable with an outer valve seat defined by the valve seating surface so as to control fuel flow from the first delivery chamber to at least the first nozzle outlet when the outer valve member lifts from its seat. The nozzle further includes an inner valve member, moveable within the axial bore and including first and second seating lines spaced apart axially from each other, both the first and second seating lines being engageable with an inner valve seat defined by the valve seating surface so as to control fuel flow from a second delivery chamber to the second nozzle outlet when the inner valve member lifts from its seat. The inner valve member defines, at least in part, a fuel flow path including an axial passage provided in the inner valve member such that fuel may flow from the first delivery chamber to the second delivery chamber.

The above arrangement optimises fuel flow efficiency to the first and second outlets without requiring a large sac volume to be disposed downstream of the inner and outer valve seats.

It is a preferred feature of the invention that the inner valve seat includes first and second seats disposed axially above and below the second outlet, respectively. It is also preferred that the first and second seating lines are defined, at least in part, by an annular groove provided on the inner valve member.

Preferably, the fuel flow path further includes at least one radial passage provided in the outer valve member and at least one radial passage provided in the inner valve member.

In a preferred embodiment, the injection nozzle includes a coupling arrangement that couples movement of the outer valve member to the inner valve member when the outer valve member moves through a distance that is greater than a predetermined distance. Still preferably, the coupling arrangement includes a sleeve member coupled to the inner valve member and a ring member coupled to the outer valve member, wherein the ring member is brought into engagement with the sleeve member when the outer valve member is moved axially through a distance that is greater than a predetermined distance so as to impart axial movement to the inner valve member.

The ring member and the sleeve member may have respective first and second end faces, the first end face of the ring member being opposed to and spaced apart from the first end face of the sleeve member by the predetermined distance when the outer valve member and the inner valve member are seated.

The invention also extends to a fuel injector incorporating an injection nozzle as described above, the fuel injector including an actuator, preferably a piezoelectric actuator, for controlling axial movement of the outer valve member.

BRIEF DESCRIPTION OF THE DRAWINGS

By way of example, the invention will now be described with reference to the accompanying drawings, in which.

DETAILED DESCRIPTION OF PREFERRED EMBODIMENTS

Figure 1:
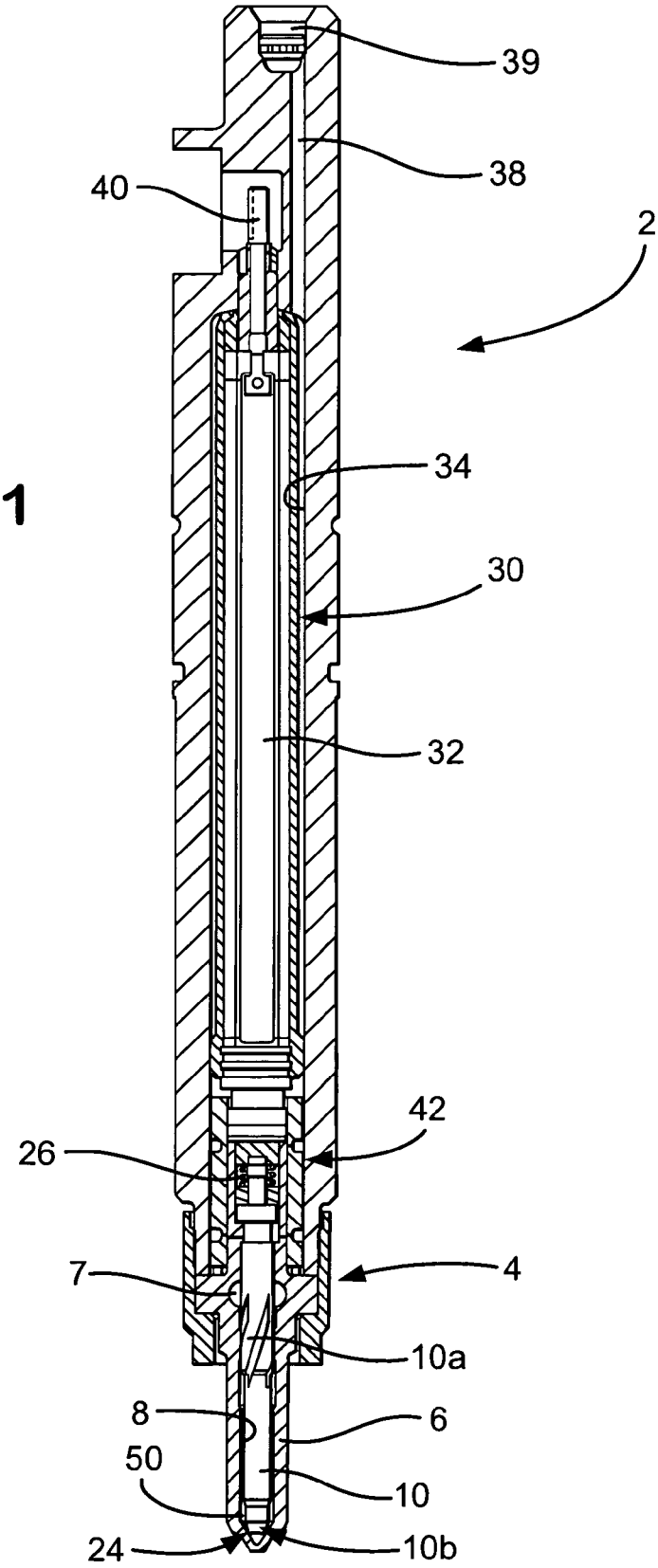
FIG. 1 is a sectional view of a fuel injector incorporating an injection nozzle in accordance with an embodiment of the present invention.

In the following description, the terms "upper" and "lower" are used having regard to the orientation of the injection nozzle as shown in the drawings. Likewise, the terms "upstream" and "downstream" are used with respect to the direction of fuel flow through the nozzle from a fuel inlet line to fuel outlets.

Figure 2:
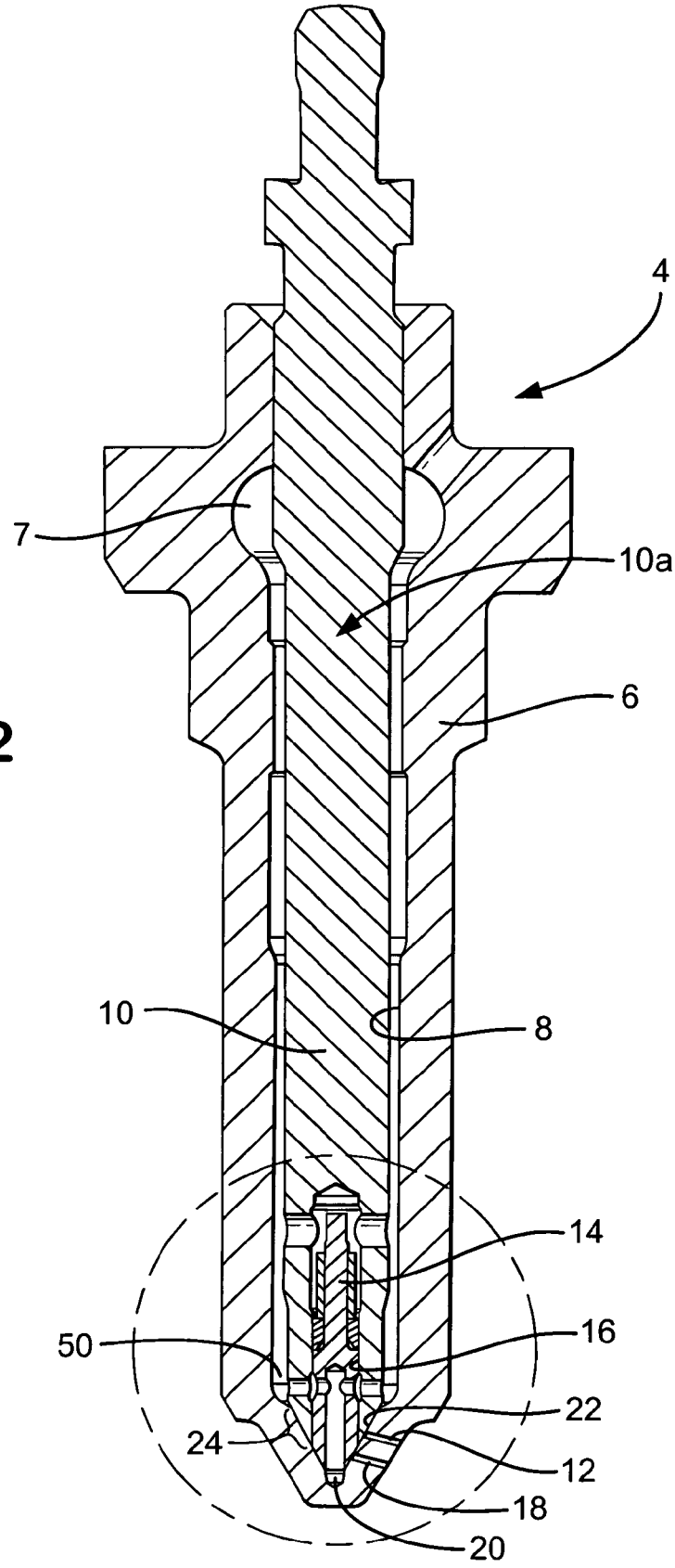
FIG. 2 is an enlarged sectional view of the injection nozzle in FIG. 1 when in a non-injecting position.

Referring to FIGS. 1 and 2 there is shown a piezoelectric fuel injector, referred to generally as 2, within which the injection nozzle of the present invention may be incorporated. The injection nozzle, referred to generally as 4 (shown in detail in FIG. 2), is of the variable orifice nozzle type. The nozzle 4 includes a nozzle body 6 being provided with a blind axial bore 8 within which an outer valve member in the form of a needle 10 is slidably received. The nozzle body 6 is also provided with first and second sets of outlets 12, 18 respectively. Movement of the outer valve needle within the bore 8 controls whether injection takes place through the first set of outlets 12 only or through both the first and second set of outlets 12, 18 simultaneously.

Fuel is supplied to the injector via an inlet 39 from, for example, a common rail or other appropriate source of pressurised fuel, which is also arranged to supply fuel to one or more other injectors. Pressurised fuel is communicated from the inlet 39, through an inlet passage 38 and an accumulator volume 34, to an annular chamber 7 defined within the bore 8 between the nozzle body 6 and an upper end region 10*a* of the outer valve needle 10. The upper end region 10*a* has a diameter substantially equal to that of the nozzle body bore 8 such that co-operation between these parts serves to guide movement of the outer valve needle 10 as it reciprocates within the bore 8, in use. Spiral flutes machined into the upper end region 10*a* provide a flow path for fuel to be communicated from the annular chamber 7, through the bore 8 and into a first delivery chamber 50. The delivery chamber 50 is defined between the outer surface of the outer valve needle 10 and a region of the nozzle body bore 8 upstream of the outlets 12, 18.

Toward its blind end, the bore 8 defines a seating surface 22 of conical form, terminating in a sac volume 20 constituting a second delivery chamber. The seating surface 22 defines an outer valve seating 24 with which a lower end region 10*b* of the outer valve needle 10 is engageable to control fuel injection through the first set of outlets 12. The outer valve needle 10 is biased towards the outer valve seating 24 by means of a first closing spring 26 in conjunction with fuel pressure in a spring chamber 26*a* in which the spring 26 is housed. The outer valve needle 10 is operable to move away from the outer valve seating 24, against the force provided by the biasing spring 26 and fuel pressure, by means of a piezoelectric actuator 30.

The piezoelectric actuator 30 comprises a stack 32 of piezoelectric elements arranged within the accumulator volume 34, and an electrical connector 40 to enable a voltage to be applied across the stack 32. In use, the accumulator volume 34 is filled with high pressure fuel so as to apply a hydrostatic loading to the stack 32. The piezoelectric actuator 30 is coupled to the outer valve needle 10 by way of a hydraulic amplifier arrangement 42. Varying the voltage applied to the stack 32 causes the stack 32 to extend and contract and this movement is transmitted via the hydraulic amplifier arrangement 42 to the outer valve needle 10.

Figure 3:
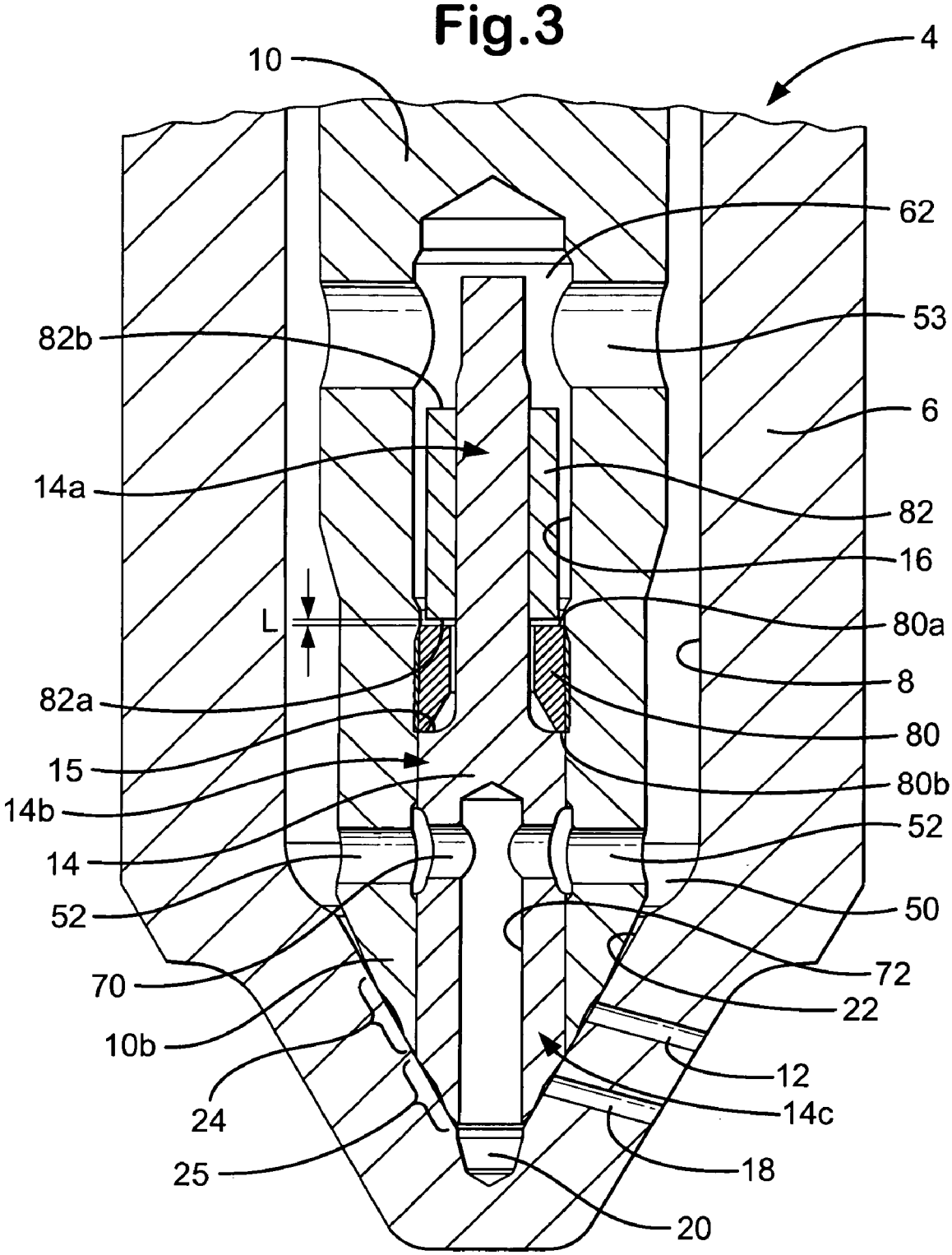
FIG. 3 is an enlarged sectional view of the injection nozzle in FIG. 2.

FIG. 3 shows the injection nozzle 4 more clearly. The nozzle 4 also includes an inner valve member in the form of a needle 14 slidably mounted within an axial bore 16 provided in the lower region 10*b* of the outer valve needle 10. The inner valve needle 14 is engageable with an inner valve seating 25 defined by the seating surface 22. Movement of the inner valve needle 14 towards and away from the inner valve seating 25 controls fuel injection through the second set of outlets 18. The inner valve needle 14 is not actuated directly but is caused to move through co-operation with the outer valve needle 10 once this has moved beyond a predetermined amount, as described below.

The inlet ends of the first and second set of outlets 12, 18 extend radially away from the seating surface 22 so that their outlet ends open at the outer surface of the nozzle body 6. It will be appreciated that in the figures, only a single outlet of each of the first and second sets of outlets 12, 18 is shown with the outlet of each set being disposed at a different axial position along the main axis of the nozzle body 6. However, in practice, each set of outlets 12, 18 may include a plurality of outlets.

The blind end of the axial bore 16 provided in the outer valve needle 10 defines a chamber 62 which serves to accommodate the upper end of the inner valve needle 14. The chamber 62 is in communication with the nozzle body bore 8 via radial passages 53, in the form of cross drillings provided in the outer valve needle 10, which provide a venting function for the chamber 62. In addition, pressurised fuel within the chamber 62 acts on the inner valve needle 14 to provide a force to bias the inner valve needle 14 against its valve seating 25.

The lower end region 10*b* of the outer valve needle 10 is provided with radial passages 52, which define part of a flow passage means. One end of each passage 52 communicates with the delivery chamber 50 and the other end of each passage 52 communicates with the axial bore 16.

The inner valve needle 14 is shaped to include three regions: an upper stem region 14*a*, a lower region 14*c*, and a step region 14*b* which is intermediate, and so separates, the stem region 14*a* and the lower region 14*c*. The step region 14*b* is of cylindrical form having a diameter which is substantially the same as the bore 16 provided in the outer valve needle 10. As a result, the step region 14*b* serves to guide movement of the inner valve needle 14 as it is moved into and out of engagement with the inner valve seating 25 to control fuel injection through the second outlets 18.

The lower region 14*c* of the inner valve needle 14 has a diameter substantially equal to that of the bore 16 and is provided with an axially extending blind bore 72. The blind end of the bore 72 communicates with the delivery chamber 50 by way of radial drillings 70 disposed substantially in line with the radial drilling 52 provided in the outer valve needle 10 when both needles 10, 14 are seated. The bore 72 and the radial drillings 70 provided in the inner valve needle 14, together with the radial drillings 52 provided in the outer valve needle 10, together define flow passage means which constitutes a secondary or supplementary flow path for fuel. When the outer valve needle 10 lifts away from the outer valve seating 24, fuel is able to flow from the upper delivery chamber 50 into the first outlets 12 directly past the outer valve seating 24. When the inner valve needle 14 lifts away from the inner valve seating 25 also, fuel is either able to flow from the upper delivery chamber 50 into the second outlets 18 directly past the outer valve seating 24 (a 'primary flow path') or indirectly through the secondary flow path past the inner valve seat 25.

The fuel passageways provided by the outer and inner valve needles 10, 14 serve to limit the restriction to fuel flow through the secondary fuel flow path 52, 70, 72 to an acceptable level whilst the lower region 14*c* guides axial movement of the inner valve needle 14 through co-operation with the adjacent region of the bore 16. Lateral movement of the lower region 14*c* due to the high pressure fuel flowing through the supplementary flow path, in use, is thus substantially eliminated. As a result, concentricity of the valve tip is improved and so a more effective and reliable seal against unwanted ingress of fuel into the combustion chamber is achieved. Moreover, since the entire length of the lower region 14*c* of the inner valve needle 14 is in contact with the bore 16 in the outer valve needle 10, the wear resistance of the inner valve needle 14 is improved.

The mechanism through which movement of the inner valve needle 14 is controlled will now be described with reference to FIG. 3. A coupling arrangement includes annular member 80 in the form of a ring which is received within the bore 16 in the outer valve needle 10. The ring member 80 is a separate and distinct part and is coupled to the outer valve needle 10 through frictional contact between the outer surface of the ring member 80 and the surface of the bore 16. That it to say, the ring member 80 is an interference fit with the bore 16.

The ring member 80 includes a first, upper end face 80*a* and a second, lower end face 80*b*, the lower end face 80*b* abutting a step or shoulder 15 defined by the step region 14*b* of the inner valve needle 14. The internal diameter of the ring member 80 is greater than the diameter of the stem region 14*a*, such that the stem region 14*a* passes through the ring member 80 and defines a clearance fit therewith. It will be appreciated that, in the position shown in FIG. 3, the force of the spring 26 serves to urge the outer valve needle 10 against its seat. In turn, this urges the inner valve needle 14 against its seat through the action of the ring member 80, which is coupled to the outer valve needle 10, acting against the shoulder 15.

The upper end face 80*a* of the ring member 80 opposes a first, lower end face 82*a* of a second annular member 82 in the form of a sleeve. The sleeve member 82 is a separate and distinct part from the inner valve needle 14 and has an external diameter that is less than that of the bore 16 and an internal diameter that is substantially equal to the diameter of the stem region 14*a*. Put another way, the sleeve member 82 is an interference fit with the stem region 14*a* and so is coupled to the inner valve needle 14 through frictional contact.

The lower end face 82*a* of the sleeve member 82 and the upper end face 80*a* of the ring member 80 are separated by a distance 'L' that is predetermined at manufacture. When the outer valve needle 10 is caused to lift, in use, the upper end face 80*a* of the ring member 80 will be brought into contact with the lower face 82*a* of the sleeve 82, thus causing the inner valve needle 14 to move also. The distance 'L' therefore determines by what amount it is necessary for the outer valve needle 10 to lift away from the outer valve seating 24 before interacting with the inner valve needle 14 and conveying movement thereto. It should be appreciated that the lower end face 82*a* of the sleeve member 82 and the upper end face 80*a* of the ring member 80 are at maximum separation (i.e. predetermined distance 'L') when both the inner valve needle 14 and the outer valve needle 10 are seated.

Figure 4:
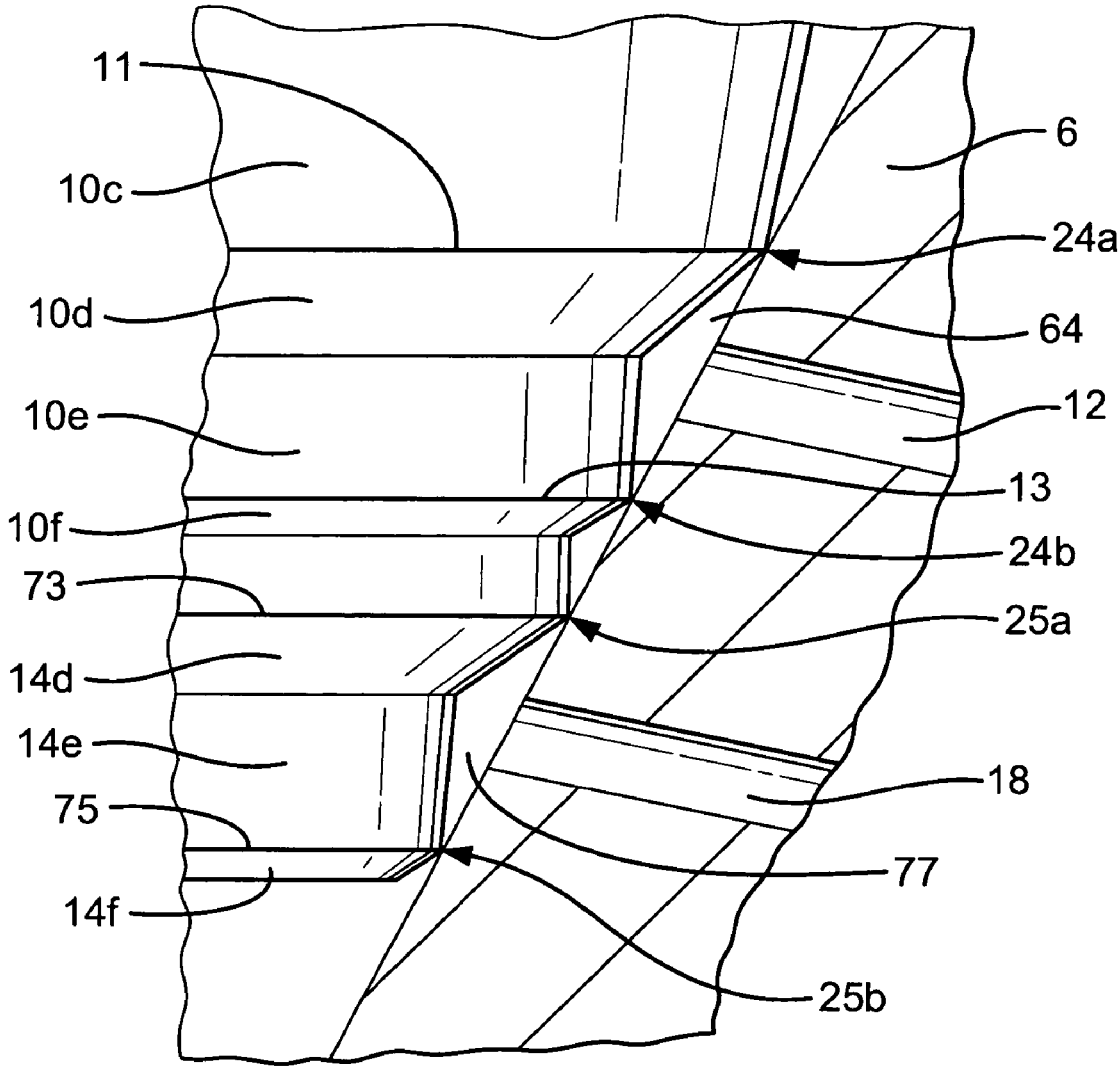
FIG. 4 is an enlarged part-sectional view of the injection nozzle in FIG. 3.

FIG. 4 (scale exaggerated for clarity) shows that the seating region 10*b* of the outer valve needle 10 is shaped to define a first (upper) seating line 11 upstream of the first outlets 12 and a second (lower) seating line 13 downstream of the first outlets 12, when the needle 10 is seated. The outer valve needle 10 is provided with a grooved or recessed region which defines, at respective upper and lower edges thereof, the upper and lower seating lines 11, 13. More specifically, FIG. 4 shows the lower end region 10*b* of the outer valve needle 10 comprises four distinct regions of substantially frustoconical form: an upper seat region 10*c*, an upper groove region 10*d*, a lower groove region 10*e* and an end region 10*f*. Thus, the upper edge of the upper groove region 10*d* defines the first seating line 11 and the lower edge of the lower groove region 10*e* defines the lower seating line 13.

The upper groove region 10*d* and the lower groove region 10*e* together form the recessed region or groove of the outer valve needle 10 and define, together with the adjacent region of the seating surface 22, an annular volume 64 for fuel at the inlet end of each of the first outlets 12. The upper and lower seating lines 11, 13 engage the outer valve seating 24 at respective first and second seats 24*a*, 24*b* thereof.

In a manner similar to that of the outer valve needle 10, the lower region 14*c* of the inner valve needle 14 is provided with a grooved or recessed region which defines, at respective upper and lower edges thereof, the upper and lower seating lines 73, 75 that are arranged axially above and below the second outlets 18, respectively, when the inner valve needle 14 is seated. Put another way, the second outlets 18 are arranged intermediate the positions at which the seating lines 73, 75 engage first and second seats 25*a*, 25*b*. More specifically, FIG. 4 shows the end of the lower region 14*c* to include three distinct regions of frustoconical form: an upper groove region 14*d*, a lower groove region 14*e* and a tip region 14*f*. The upper groove region 14*d* and the lower groove region 14*e* together form the recessed region or groove of the inner valve needle 14 and define, together with the adjacent area of the seating surface 22, an annular volume 77 for fuel at the inlet ends of the second outlets 18. The upper edge of the upper groove region 14*d* defines the first seating line 73 and the lower edge of the lower groove region 14*e* defines the lower seating line 75, which engage the inner valve seating 25 at respective first and second seats 25*a*, 25*b* thereof.

Figure 5:
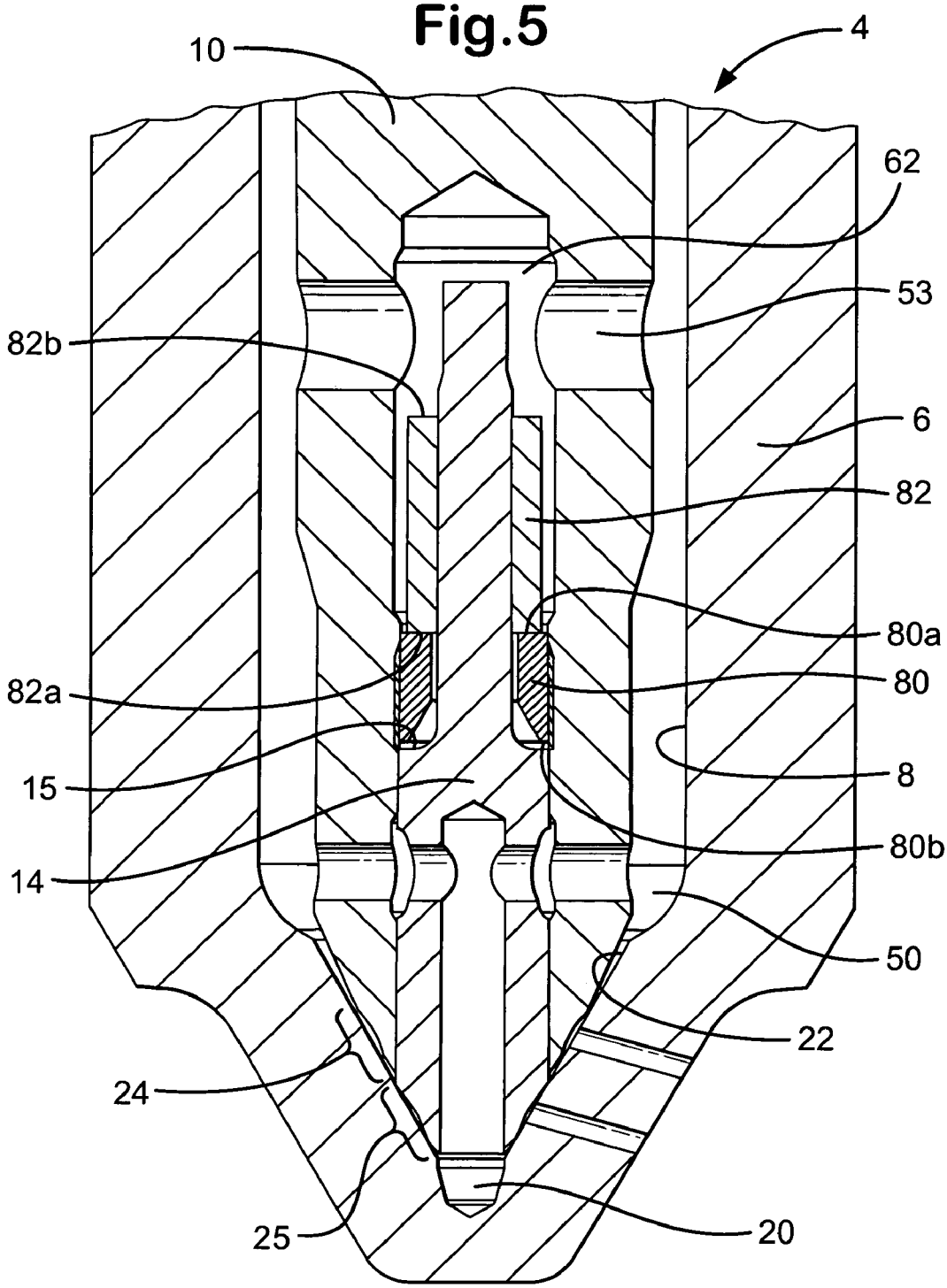
FIG. 5 is a sectional view of the injection nozzle in FIG. 3 when in a first injecting position.

Operation of the injector 2 will now be described. Fuel under high pressure is delivered from a high pressure fuel source (e.g. a common rail) to the annular chamber 7 via the inlet 39, the inlet passage 38 and the accumulator volume 34. Hence, fuel is delivered to the bore 8 and thus the upper and lower delivery chambers 50, 20. Initially, the piezoelectric actuator 30 is energised so that the stack 32 is in an extended state and the injection nozzle 4 is in the position shown in FIG. 3. At this point, the outer valve needle 10 is held against its seating 24 due to the biasing force of the spring 26 in conjunction with a force due to fuel pressure within the spring chamber 26*a*. The inner valve needle 14 is held against its seating due to the ring member 80 abutting the step region 14*b*. In this non-injecting state the actuator 30 is held at a relatively high energisation level. When the piezoelectric actuator 30 is de-energized to a first energisation level, the stack 32 is caused to contract, resulting in a lifting force being transmitted to the outer valve needle 10 by way of the hydraulic amplifier arrangement 42. The outer valve needle 10 is thus urged to move away from the outer valve seating 24, thereby disengaging the upper seating line 11 from the upper seat 24*a* and disengaging the lower seating line 13 from the lower seat 24*b*. This is the position of the injection nozzle 4 in FIG. 5.

During this initial de-energisation of the actuator 30, the outer valve needle 10 is caused to move through a distance less than the distance 'L'. The ring member 80 is carried with the outer valve needle 10 during this initial movement because of the frictional engagement between the parts and so the upper end face 80*a* of the ring member 80 approaches, or moves towards, the opposing end face 82*a* of the sleeve member 82. At the same time, the lower end face 80*b* of the ring member 80 will disengage from the shoulder 15 of the step region 14*b*. Providing that the distance through which the outer valve needle 10 moves is less than the pre-determined distance 'L', the upper end face 80*a* of the ring member 80 does not engage the lower end face 82*a* of the sleeve member 82. Therefore, the inner valve needle 14 remains seated against the inner valve seating 25, under the influence of pressurised fuel within the chamber 62 acting on the upper end of the inner valve needle 14.

When the outer valve needle 10 is moved through this initial amount, pressurised fuel is able to flow along the primary flow path from the upper delivery chamber 50, past the upper seating line 11 into the annular volume 64 and thus through the first outlets 12 into the combustion chamber (not shown). Fuel will also be able to flow along the secondary flow path from the upper delivery chamber 50, through the radial passages 52 and the axial bore 16 into the lower delivery chamber 20.

During this phase of injector operation, it will be appreciated that movement of outer valve needle 10 is decoupled from the inner valve needle 14. Whilst the inner valve needle 14 is seated against the inner valve seating 25, fuel is neither able to flow from the upper delivery chamber 50 past the first seat 25*a*, nor from the lower delivery chamber 20 past the second seat 25*b*, to the second outlets 18. The above described condition represents fuel injection optimised for relatively low power applications since only a relatively small volume of fuel is injected through the first set of relatively small outlets 12 only.

If, at this point, it is necessary to terminate injection through the first outlets 12, the piezoelectric actuator 30 is re-energised to its initial energisation level causing the stack 32 to extend. As a result, the outer valve needle 10 is caused to re-engage with the outer valve seating 24, at both the first and second seats 24*a*, 24*b*, under the influence of the biasing force of the closure spring 26 in conjunction with fuel pressure within the spring chamber 26*a*. Under these circumstances, the injection nozzle 4 again takes up the position shown in FIG. 3.

Figure 6:
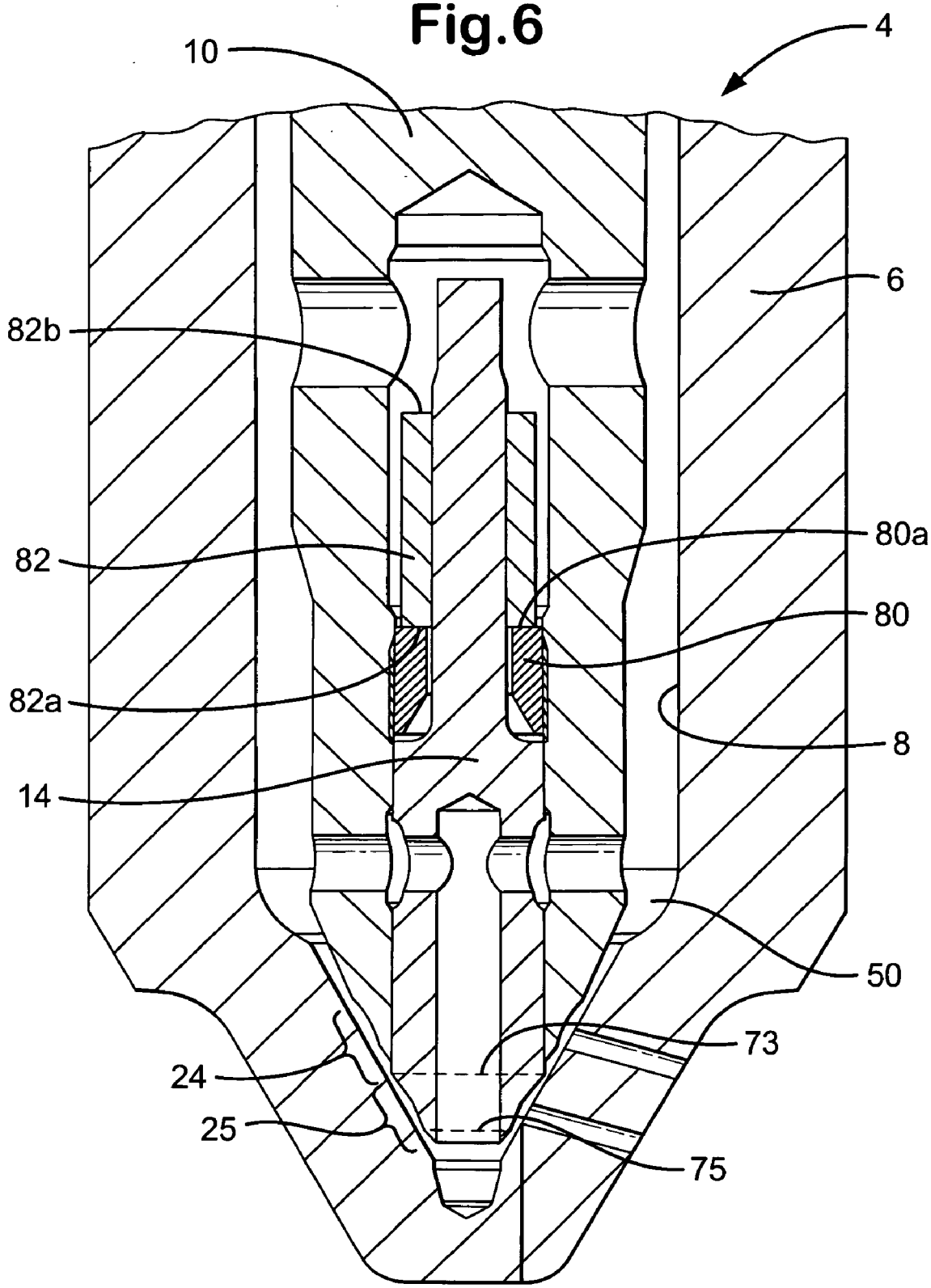
FIG. 6 is a sectional view of the injection nozzle in FIG. 3 when in a second injecting position.

FIG. 6 shows the injection nozzle during a subsequent, or alternative, stage of injector operation in which the piezoelectric actuator 30 may be de-energised further to a second energisation level causing the stack length to be reduced further. As a result, the outer valve needle 10 is urged away from the outer valve seating by a further amount, which is greater than the predetermined distance 'L'. In such circumstances, the upper end face 80*a* of the ring member 80 is caused to engage the lower end face 82*a* of the sleeve member 82, thereby causing the movement of the outer valve needle 10 to be conveyed or coupled to the inner valve needle 14 and causing the inner valve needle 14 to lift from its seating 25.

As the inner valve needle 14 lifts away from the inner valve seating 25, fuel within the lower delivery chamber 20 is able to flow past the lower seating line 75 and through the second outlets 18 into the combustion chamber, supplementing the fuel flowing past the outer valve seating 24 and through the first outlets 12. In addition, fuel is also able to flow to the second outlets 18 from the upper delivery chamber 50 and past the upper seating line 73 (see FIG. 4). It should be understood that the ratio of the fuel flow from the first and second outlets 12, 18, respectively, that contributes to the total fuel flow depends on the relative spray hole sizes and the amount by which the outer and inner valve needles 10, 14 lift from their respective seats 24, 25. Thus, a greater proportion of fuel may be injected through the second outlets 18 if they are formed with a relatively large cross sectional area in comparison with the first outlets 12.

Figure 7A:
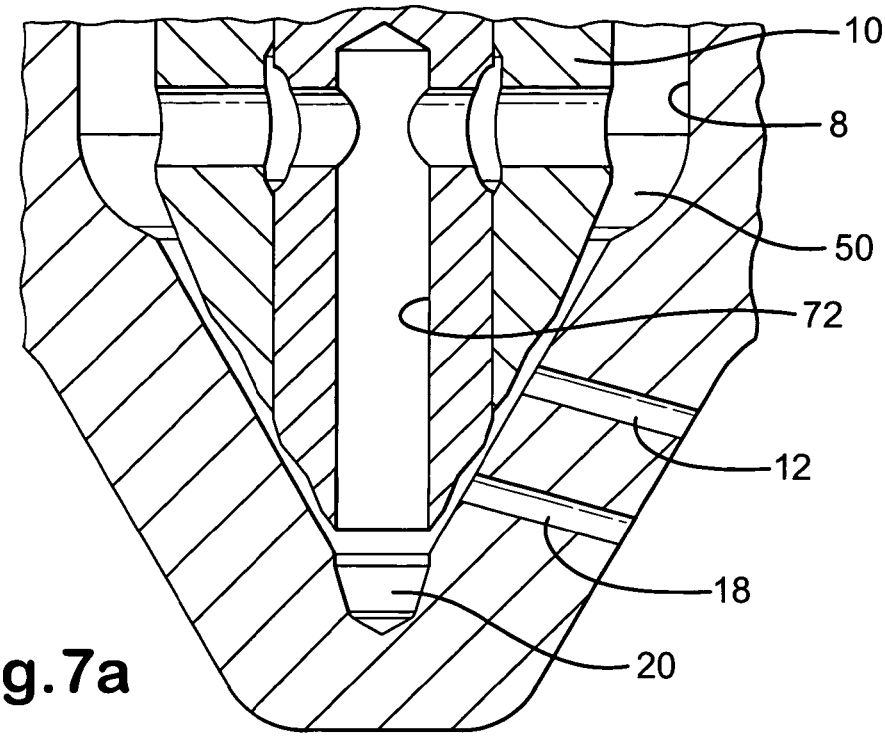
FIGS. 7*a* and 7*b* are sectional views of an injection nozzle in accordance with a second embodiment of the invention.
Figure 7B:
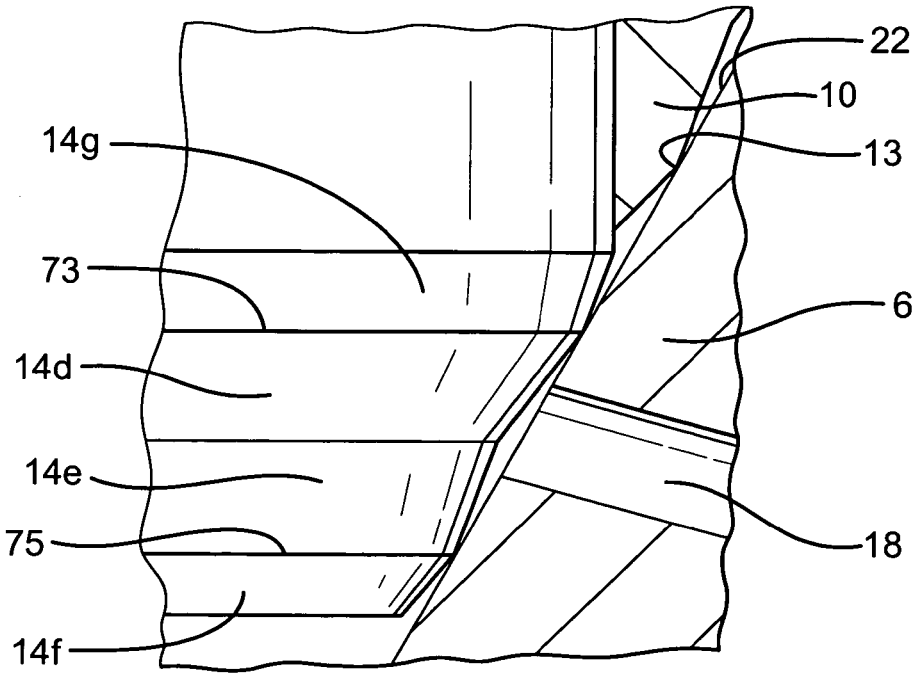

FIGS. 7*a* and 7*b* show an alternative embodiment of the invention that further improves the flow efficiency of the injection nozzle 4. Where appropriate, like parts to those previously described are denoted with like reference numerals. The embodiment in FIGS. 7*a* and 7*b* differs from that described previously in that it includes an additional upper seat region 14*g* of frustoconical form above the groove region 14*d*. In contrast, the region axially above the groove region 14*d* of the previous embodiment is of cylindrical form. More specifically, FIG. 7*b* shows that the upper seating line 73 of the inner valve needle 14 is defined at the intersection between the upper groove region 14*d* and the upper seat region 14*g*. The inclusion of the upper seat region 14*g* reduces the angle that the surface of the inner valve needle 14 makes with the seating surface 22 upstream of the upper seating line 73. As a result, disturbance to the flow of fuel in the region downstream of the lower seat 24*b* of the outer valve needle 10 is guarded against, which reduces the likelihood of premature seat wear.

Figure 8A:
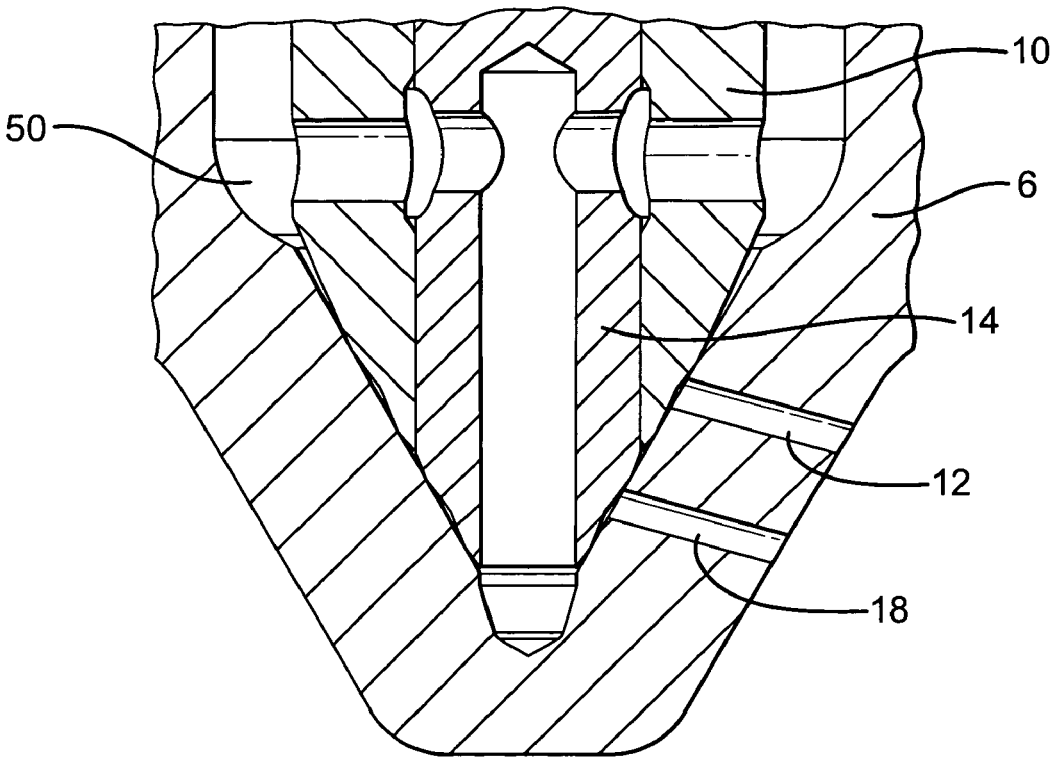
FIGS. 8*a* and 8*b* are sectional views of an injection nozzle in accordance with a third embodiment of the invention.
Figure 8B:
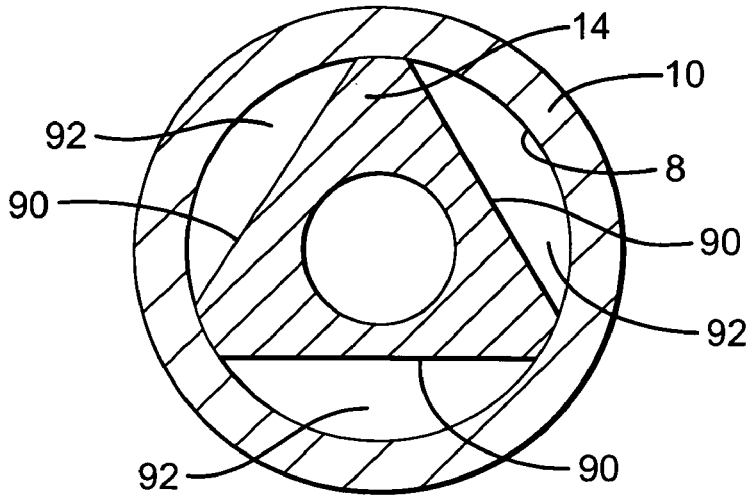

It is a further optional feature (illustrated in FIGS. 8*a* and 8*b*), for the lower region 14*c* of the inner valve needle 14 to include three flats or recesses 90, which, together with the bore 16, define three chambers 92 for fuel. As a result, when the outer valve needle 10 lifts away from the outer valve seating 24, fuel is able to flow from the upper delivery chamber 50, through the chambers 92 and past the lower seating line 13 (and lower seat 24*b*) to the first outlets 12. Thus, there are two flow paths for pressurised fuel to the first outlets 12: a first flow path past the upper valve seat 24*a* directly from the upper delivery chamber 50 and a second flow path past the lower valve seat 24*b*, indirectly from the upper delivery chamber 50 via the chambers 92. The functional result of this embodiment is that fuel flow efficiency is further improved over those embodiments that have been described previously. In this embodiment, it should be appreciated that the recesses 90 should be machined onto the surface of the inner valve needle 14 such that they do not disrupt the seating line 73. Furthermore, it should also be appreciated that more than three recesses could be provided on the inner valve needle 14 to achieve a sufficient flow area, for example, if it is necessary to limit the depth of the recesses 90.

A method by which the inner and outer valve needles 14, 10 of the above described embodiments may be assembled within the nozzle body 6 will now be described. Initially the ring member 80 is caused to receive the stem region 14*a* of the inner valve needle 14 so that the lower face 80*b* of the ring member 80 abuts the step region 14*b*. With the ring member 80 in position, the sleeve member 82 is then caused to receive the stem region 14*a* such that the ring member 80 is retained on the inner valve needle 14. In order to set the predetermined distance 'L', a spacer tool, such as a shim of thickness 'L' (not shown), is positioned against the upper end face 80*a* of the ring member 80, whereby the sleeve member 82 is pushed so as to engage the shim. When the shim is removed, the necessary separation of distance 'L' is established between the upper end face 80*a* of the ring member 80 and the lower end face 82*a* of the sleeve member 82.

Following assembly of the inner valve needle 14, the ring member 80, and the sleeve member 82, the combined inner valve needle 14 and ring/sleeve assembly 80, 82 is pushed into the bore 16 of the outer valve needle 10. The inner and outer valve needles 14, 10 together are then inserted into the nozzle body bore 8 such that the seating lines 11, 13 of the outer valve needle 10 engage with their respective seats 24*a*, 24*b* of the outer valve seating 24 and the seating lines 73, 75 of the inner valve needle 14 engage with their respective seats 25*a*, 25*b* of the inner valve seating 25. Following assembly of the nozzle a bedding operation is performed in order to establish effective seals at the inner and outer seatings 24, 25. The seat bedding operation comprises applying a constant predetermined axial force to the outer valve needle 10, causing the upper and lower seating lines 11, 13 to "bed in" over the upper and lower seats 24*a*, 24*b* respectively. As an alternative to applying a predetermined constant axial force to the outer valve needle 10, the bedding in operation could also be dynamic.

It will be understood by those who practice the invention and those skilled in the art, that various modifications and improvements may be made to the invention without departing from the scope of the invention, as defined by the claims. Accordingly, reference should be made to the claims and other conceptual statements in determining the scope of the invention.

For example, although the inner valve needle 14 is forced into engagement with its seating 25 by the ring member 80 abutting the shoulder of the step region 14*b*, it is possible that, in use, the lower end face 80*b* of the ring member 80 may wear such that a clearance is established between the lower end face 80*b* and the shoulder 15 when the inner and outer valve needles 14, 10 are seated. This may compromise the seal established by the inner valve needle 14. A resilient member such as a helical spring (not shown) may be arranged within the chamber 62 to provide a further biasing force to the inner valve needle 14. Such a spring may abut against the upper end face 82*b* of the sleeve member 82 such that the biasing force is transmitted to the inner valve needle 14 via the frictional coupling between these parts. Alternatively the spring may abut a separate abutment member located within the chamber 62.

Furthermore, although the ring member 80 and the sleeve member 82 are coupled to the outer valve needle 10 and inner valve needle 14, respectively, through frictional contact, it will be appreciated that coupling may be achieved through alternative means, for example by gluing or soldering. Further, the ring member 80 may be in the form of a "C" shaped pin member having lateral resilience, by which means the ring member 80 maintains frictional contact with the bore 16.

In addition, although in the above described embodiments, the flow passage means of the inner valve needle 14 is defined by the axial bore 72 and the radial drillings 52, it will be appreciated that this need not be the case. For example, the inner valve needle 14 may be supplied with a passage extending along substantially its entire length for performing the function of supplying pressurised fuel to the lower delivery chamber 20.

It should be understood that although the injection nozzle 4 of the present invention has been described as suitable for use within an injector having a piezoelectric actuator, it is entirely possible that the injector may include an alternative form of actuator for moving the needles 10, 14. For example, instead of a piezoelectric actuator, the outer valve needle 10 may be moved by means of an electromagnetic actuator. Moreover, although the piezoelectric actuator 30 is described here as being coupled to the outer valve needle 10 via a hydraulic amplifier arrangement 42, as an alternative the actuator may be mechanically coupled to the outer valve needle 10.

The invention claimed is:

1. An injection nozzle for an internal combustion engine, the injection nozzle including:

a nozzle body provided with a bore defining a valve seating surface, and having a first nozzle outlet and a second nozzle outlet;

a first delivery chamber upstream of the first and second nozzle outlets;

an outer valve member, moveable within the bore and itself provided with an axial bore, wherein the outer valve member is engageable with an outer valve seat defined by the valve seating surface so as to control fuel flow from the first delivery chamber to at least the first nozzle outlet when the outer valve member lifts from its seat;

an inner valve member, moveable within the axial bore and including first and second seating lines spaced apart axially from each other, both of the first and second seating lines being engageable with an inner valve seat defined by the valve seating surface so as to control fuel flow from a second delivery chamber to the second nozzle outlet when the inner valve member lifts from the inner valve seat, wherein the inner valve member defines, at least in part, a flow path including an axial passage provided in the inner valve member such that fuel may flow from the first delivery chamber to the second delivery chamber;

a sleeve member coupled to the inner valve member; and a ring member coupled to the outer valve member;

wherein the ring member and the sleeve member have respective first and second end faces;

wherein the ring member is brought into engagement with the sleeve member when the outer valve member is moved axially through a distance that is greater than a predetermined distance so as to impart axial movement to the inner valve member; and wherein the second end face of the ring member abuts a shoulder provided by the inner valve member.

2. The injection nozzle as claimed in claim 1, wherein the inner valve seat includes first and second seats disposed axially above and below the second outlet, respectively.

3. The injection nozzle as claimed in claim 1, wherein the flow path further includes at least one radial passage provided in the inner valve member.

4. The injection nozzle as claimed in claim 1, wherein the flow path includes at least one radial passage provided in the outer valve member.

5. The injection nozzle as claimed in claim 1, wherein the first and second seating lines are defined, at least in part, by an annular groove provided on the inner valve member.

6. The injection nozzle as claimed in claim 1, wherein the outer valve member defines first and second seating lines for engagement with first and second seats defined by the outer valve seating, the first and second seats being disposed axially above and below the first outlet, respectively.

7. The injection nozzle as claimed in claim 6, wherein the first and second seating lines of the outer valve member are defined, at least in part, by an annular groove provided on the outer valve member.

8. The injection nozzle as claimed in claim 1, wherein the ring member and the sleeve member have respective first and second end faces, the first end face of the ring member being opposed to and spaced apart from the first end face of the sleeve member by the predetermined distance when the outer valve member and the inner valve member are seated.

9. An injector for use in an internal combustion engine, wherein the injector includes an injection nozzle as claimed in claim 1 and an actuator for controlling axial movement of the outer valve member.

10. An injector as claimed in claim 9, wherein the actuator is a piezoelectric actuator.

11. An injection nozzle for an internal combustion engine, the injection nozzle including:

a nozzle body provided with a bore defining a valve seating surface, and having a first nozzle outlet and a second nozzle outlet;

a first delivery chamber upstream of the first and second nozzle outlets;

an outer valve member, moveable within the bore and itself provided with an axial bore, wherein the outer valve member is engageable with an outer valve seat defined by the valve seating surface so as to control fuel flow from the first delivery chamber to at least the first nozzle outlet when the outer valve member lifts from its seat; an inner valve member, moveable within the axial bore and including first and second seating lines spaced apart axially from each other, both of the first and second seating lines being engageable with an inner valve seat defined by the valve seating surface so as to control fuel flow from a second delivery chamber to the second nozzle outlet when the inner valve member lifts from the inner valve seat; and a coupling arrangement configured to couple movement of the outer valve member to the inner valve member when the outer valve member is moved axially through a distance that is greater than a predetermined distance, wherein the inner valve member defines, at least in part, a flow path including an axial passage provided in the inner valve member such that fuel may flow from the first delivery chamber to the second delivery chamber;

wherein the coupling arrangement comprises a sleeve member coupled to the inner valve member and a ring member coupled to the outer valve member, wherein the ring member and the sleeve member have respective first and second end faces; and wherein the ring member is brought into engagement with the sleeve member when the outer valve member is moved axially through a distance that is greater than the predetermined distance so as to impart axial movement to the inner valve member, wherein the second end face of the ring member abuts a shoulder provided by the inner valve member.

12. The injection nozzle as claimed in claim 11, wherein the ring member and the sleeve member have respective first and second end faces, the first end face of the ring member being opposed to and spaced apart from the first end face of the sleeve member by the predetermined distance when the outer valve member and the inner valve member are seated.

13. The injection nozzle as claimed in claim 12, wherein the ring member and the sleeve member have respective first and second end faces, the first end face of the ring member being opposed to and spaced apart from the first end face of the sleeve member by the predetermined distance when the outer valve member and the inner valve member are seated.

14. An injection nozzle for an internal combustion engine, the injection nozzle including:

a nozzle body provided with a bore defining a valve seating surface, and having a first nozzle outlet and a second nozzle outlet;

a first delivery chamber upstream of said first and second nozzle outlets; an outer valve member, moveable within the bore and itself provided with an axial bore, wherein the outer valve member is engageable with an outer valve seat defined by the valve seating surface so as to control fuel flow from the first delivery chamber to at least the first nozzle outlet when the outer valve member lifts from its seat;

an inner valve member (14), moveable within the axial bore and including first and second seating lines spaced apart axially from each other, both first and second seating lines being engageable with an inner valve seat defined by the valve seating surface so as to control fuel flow from a second delivery chamber to the second nozzle outlet when the inner valve member lifts from the inner valve seat; and a sleeve member coupled to the inner valve member and a ring member coupled to the outer valve member, wherein the ring member and the sleeve member have respective first and second end faces, wherein the ring member is brought into engagement with the sleeve member when the outer valve member is moved axially through a distance that is greater than a predetermined distance so as to impart axial movement to the inner valve member, and wherein the inner valve member defines, at least in part, a flow path including an axial passage provided in the inner valve member such that fuel may flow from the first delivery chamber to the second delivery chamber, wherein the second end face of the ring member abuts a shoulder provided by the inner valve member.

* * * * *